US009885144B2

(12) United States Patent
Cho et al.

(10) Patent No.: US 9,885,144 B2
(45) Date of Patent: Feb. 6, 2018

(54) CLOTHES DRYER

(71) Applicant: SAMSUNG ELECTRONICS CO., LTD., Suwon-si (KR)

(72) Inventors: Seong Joon Cho, Incheon (KR); Jin Woo So, Seongnam-si (KR); Yun Hwan Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 202 days.

(21) Appl. No.: 14/638,293

(22) Filed: Mar. 4, 2015

(65) Prior Publication Data

US 2015/0252516 A1 Sep. 10, 2015

(30) Foreign Application Priority Data

Mar. 7, 2014 (KR) ..... 10-2014-0027442

(51) Int. Cl.
*F26B 3/00* (2006.01)
*D06F 58/22* (2006.01)
*D06F 58/20* (2006.01)

(52) U.S. Cl.
CPC ..... *D06F 58/22* (2013.01); *D06F 58/20* (2013.01)

(58) Field of Classification Search
CPC ..... D06F 58/22
USPC ..... 34/292, 480, 82
See application file for complete search history.

(56) References Cited

U.S. PATENT DOCUMENTS

2012/0144687 A1* 6/2012 Yeom ..... D06F 58/22 34/82
2014/0096407 A1* 4/2014 Sar ..... D06F 39/12 34/82

* cited by examiner

*Primary Examiner* — John McCormack
(74) *Attorney, Agent, or Firm* — Staas & Halsey LLP

(57) ABSTRACT

A clothes dryer with a filter unit and a filter cover having a coupling structure corresponding to each other. The clothes dryer includes a body, a drum installed inside the body, a drying unit configured to dry air passed through the drum, a filter unit disposed on the drying unit and detachably installed on the body, a filter cover fixed by provided with one side thereof being installed on the body and the other side thereof being coupled to the filter unit. When the filter unit is not assembled, a user may notice the filter unit not being assembled due to the filter unit and the filter cover, both of which are provided with a coupling structure corresponding to each other.

9 Claims, 8 Drawing Sheets

CLOTHES DRYER

CROSS-REFERENCE TO RELATED APPLICATIONS

This application claims the benefit of Korean Patent Application No. 10-2014-0027442, filed on Mar. 7, 2014 in the Korean Intellectual Property Office, the disclosure of which is incorporated herein by reference.

BACKGROUND

1. Field

Embodiments of the present disclosure relate to a clothes dryer, more particularly a clothes dryer provided with a filter unit and a filter cover having a coupling structure corresponding to each other.

2. Description of the Related Art

A clothes dryer is an appliance to dry wetted-laundry after washed by using hot and dry air.

In general, a clothes dryer may be classified into a gas type and an electricity type depending on power sources, and may be classified into exhaust type dryers and condensing type dryers depending on the method of processing moisture collected from laundry.

The exhaust type dryer is configured to discharge humid air discharged from a drum to the outside through an air discharge duct which is extended long.

In the condensing dryer, humid air discharged from the drum is condensed to remove the moisture therefrom using a heat exchanger, and the dried air is conducted back into the drum again so as to be re-circulated. Since the flow of air is formed in a shape of a closed loop, it is difficult to use gas as a heat source and thus electricity is mainly used as a heat source. Therefore, maintenance cost is relatively expensive, but an air discharge duct is not needed since air is circulated between laundry placed inside the drum and the heat exchanger so the installation of the clothes dryer is easy.

The condensing type dryer is needed to have a filter since a foreign substance, such as lint, is generated during drying clothes. Therefore, the condensing type dryer may include at least one filter unit. The filter unit may be provided to be cleaned by being separated.

Users may use a clothes dryer without reassembling a filter unit after separating the filter unit. At this time, there may be inconvenience because a function to confirm whether the filter unit is reassembled is not equipped.

SUMMARY

Therefore, it is an aspect of the present disclosure to provide a clothes dryer capable of confirming whether a filter unit is mounted.

It is another aspect of the present disclosure to provide a clothes dryer provided with a filter unit and a filter cover having a coupling structure corresponding to each other so that the filter cover is not assembled when the filter unit is not assembled.

Additional aspects of the present disclosure will be set forth in part in the description which follows and, in part, will be obvious from the description, or may be learned by practice of the invention.

In accordance with one aspect of the present disclosure, a clothes dryer includes a body, a drum installed inside the body, a drying unit configured to dry air passed through the drum, a filter unit disposed between the drum and the drying unit and installed to be detachable from the body, a filter cover provided with one side thereof being installed on the body and fixed by the other side thereof being coupled to the filter unit.

The filter cover may include a first coupling member and the filter unit may include a second coupling member to correspond to the first coupling member so that the first coupling member may be connected to the second coupling member and the filter cover may be fixed to the filter unit.

The first coupling member may be disposed the rear surface of the filter cover, and the second coupling member may be disposed the front surface of the filter unit so that the filter cover may be coupled to the front surface of the filter unit to be fixed.

The filter cover may include a rotation member rotatably coupled to the body, wherein the rotation member may be coupled to one side of the body.

The first coupling member and the rotation member may be vertically spaced apart from each other so that the filter cover may be rotated by the connection the first coupling member and the second coupling member.

The body may include a front panel provided with a door to open/close the drum, wherein the filter cover together with the front panel may form an external appearance of the front surface of the body.

The filter cover and the filter unit may be disposed on one side of a lower portion of the door.

The filter unit may include at least one fixation member to be fixedly installed on the body, and the filter cover may include at least one check member corresponding to the at least one fixation member to detect whether the filter unit is fixed to the body.

The at least one fixation member may be disposed on the front surface of the filter unit, and the at least one check member may be disposed on the rear surface of the filter cover so that the filter cover may be coupled to the front surface of the filter unit.

The drying unit may include at least one heat exchanger exchanging heat with air circulated, wherein the filter unit may be disposed on one side of the at least one heat exchanger.

The filter unit may include a sealing member to prevent the heat loss of the at least one heat exchanger.

The clothes dryer may include a circulation fan disposed on a moving path of air to allow air to be circulated by connecting the drum to the drying unit, wherein the filter unit may be disposed between the drum and the drying unit.

The clothes dryer may include a primary filter unit disposed between the filter unit and the drum to filter air passed through the drum.

The primary filter unit may be disposed on one side of the drum, wherein the filter unit may be disposed on the front surface of the drying unit.

In accordance with one aspect of the present disclosure, a clothes dryer includes a body, a drum installed inside the body, a drying unit configured to dry air passed through the drum, a first filter unit disposed on one side of the drum to allow air passed through the drum to penetrate, a second filter unit disposed between the drying unit and the first filter unit to allow air passed through the first filter to penetrate, and a filter cover configured to open/close at least one portion of the body and provided with a coupling structure corresponding to the second filter.

The body may include a filter opening so that the second filter may be installed inside the body, wherein the filter cover may be installed to open/close the filter opening.

The filter cover may include a rotation member rotatably coupled to one side of the filter opening, wherein the filter cover may open/close the filter opening by being rotated depending on whether the second filter is coupled to the body.

The filter cover and the second filter may include a first coupling member and the second coupling member respectively, both of which correspond to each other, wherein the filter cover may close the filter opening when the first coupling member and the second coupling member are connected.

In accordance with one aspect of the present disclosure, a clothes dryer includes a body provided with a front panel, a drum installed inside the body, a filter unit configured to filter air passed through the drum, a filter cover disposed on a lower portion of the front panel to form an external appearance of the clothes dryer, wherein the filter unit and the filter cover may include a coupling structure corresponding to each other.

The filter cover and the second filter may include a first coupling member and the second coupling member respectively, both of which correspond to each other, wherein the filter cover may be coupled to the front surface of the filter unit by connecting the first coupling member to the second coupling member.

The filter cover may include a rotation member rotatably coupled to the body, wherein the rotation member and the first coupling member may be vertically space apart from each other to allow the filter cover to be rotated with respect to the body when the filter unit is separated from the body.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Reference will now be made in detail to embodiments of the present disclosure, examples of which are illustrated in the accompanying drawings.

Figure 1:
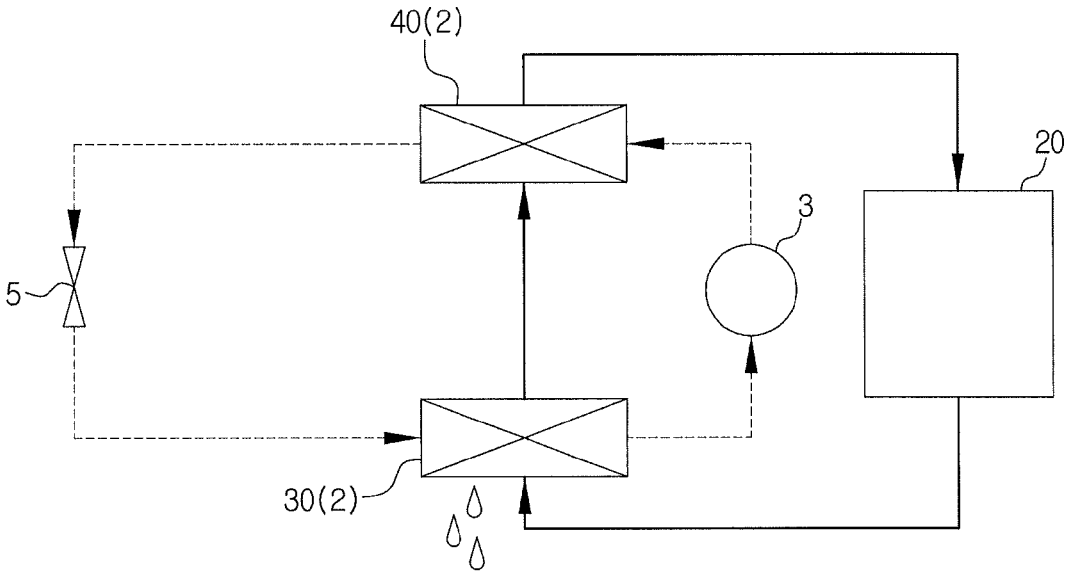
FIG. 1 is a view illustrating a drying cycle of a clothes dryer in accordance with one embodiment of the present disclosure.

FIG. 1 is a view illustrating a drying cycle of a clothes dryer 1 in accordance with one embodiment of the present disclosure.

FIG. 1 illustrates the flow of air and a refrigerant cycle in a condensing type dryer. Hereinafter a clothes dryer 1 of the present disclosure represents a condensing type dryer. This is merely exemplary, and the clothes dryer 1 of the present disclosure may include various types of drying.

The flow of air is illustrated by a solid line, and the flow of a refrigerant is illustrated by a dotted line. As for the flow of the refrigerant, the refrigerant may be circulated in the refrigerant cycle in general. The refrigerant cycle may include a compressor 3, a condenser 40, an expansion valve 5, an evaporator 30. The refrigerant may be circulated in a series of processes including compression-condensation-expansion-evaporation. The condenser 40 and the evaporator 30 may be provided in a shape of a heat exchanger to exchange heat with air.

The compressor 3 discharges refrigerant gas in a compressed state of high temperature and high pressure, the refrigerant gas discharged is flowed into the condenser 40. The condenser 40 may condense the compressed refrigerant gas into a liquid refrigerant, to release heat to the surroundings by the condensation process.

The expansion valve 5 expands the liquid refrigerant in the high-temperature and high-pressure state condensed by the condenser 40 into a liquid refrigerant in low pressure state. The evaporator 30 evaporates the refrigerant expanded by the expansion valve 5 and returns the refrigerant in the low-temperature and low-pressure state to the compressor 3. The evaporator 30 may remove ambient heat through the evaporation process of changing a refrigerant gas to a refrigerant liquid.

In FIG. 1, the flow of changes in temperature and humidity of the air are illustrated, the flow of air inside the clothes drier 1 will be described later. A condensing type dryer may dry laundry by circulating air without suctioning and exhausting air.

High temperature and high humid air which is discharged from a drum 20 may penetrate the evaporator 30. The air deprived heat by passing through the evaporator 30 may become lower temperature and less the amount of water vapor which is contained in. That is, high temperature and high humid air that is discharged from the drum 20 may be changed to air that is low temperature and dried as passing through the evaporator 30.

Figure 4:
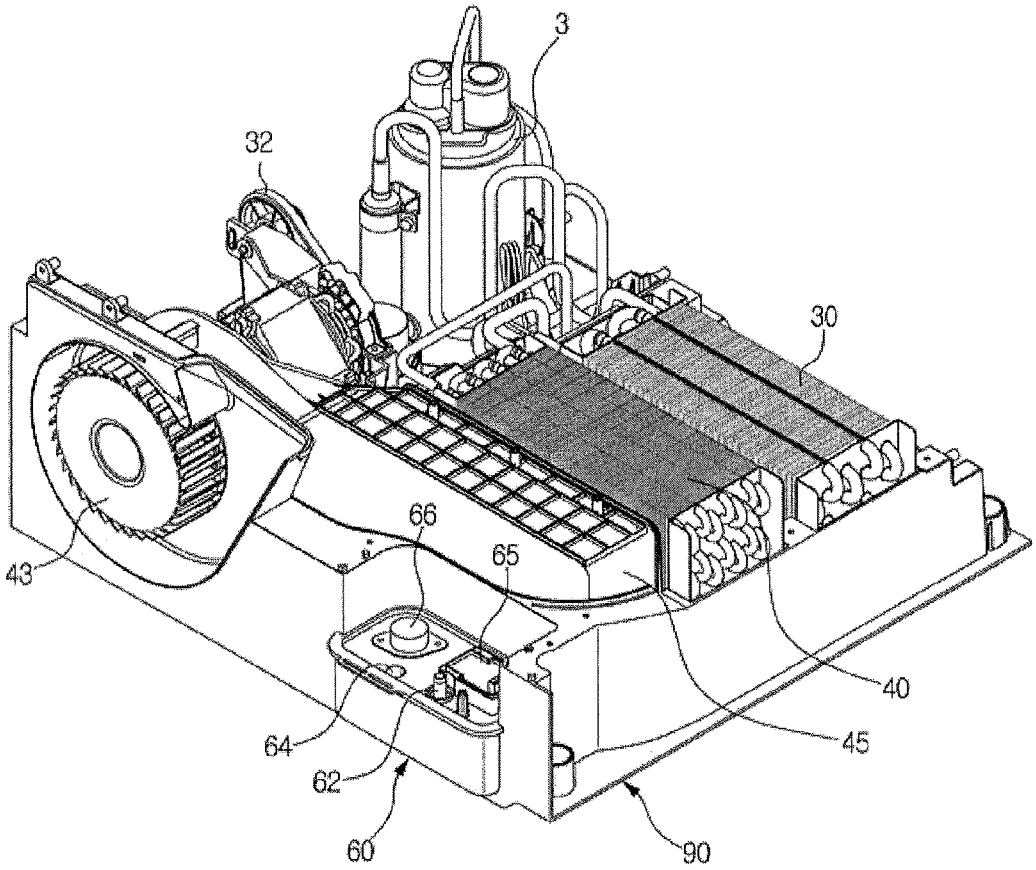
FIG. 4 is a view illustrating a base of the clothes dryer in accordance with one embodiment of the present disclosure.

Condensed water may be generated in the process of discharging of the water while High temperature and high humid air that is discharged from the drum 20 is cooled by the evaporator 30. Condensed water falls into a lower portion of the evaporator 30 and is collected by a condensed water collector 60, refer to FIG. 4, provided at the lower portion of the evaporator 30. The condensed water collected in the condensed water collector 60 may be moved to a water collection tank 50, refer to FIG. 2, or may be discharged to the outside of a body 10.

Low temperature and dry air by passing through the evaporator 30 may penetrate the condenser 40. A temperature of air in the low temperature and dried state is increased by passing through the condenser 40. That is, low temperature and dry air, which is discharged from the evaporator 30 is changed to air in high temperature and dried state by passing through the condenser 40.

The high temperature and dry air may dry laundry by being supplied into the drum 20 again. Air removing moisture from laundry may include a large amount of water vapor and may be circulated in a serious of processes.

Figure 2:
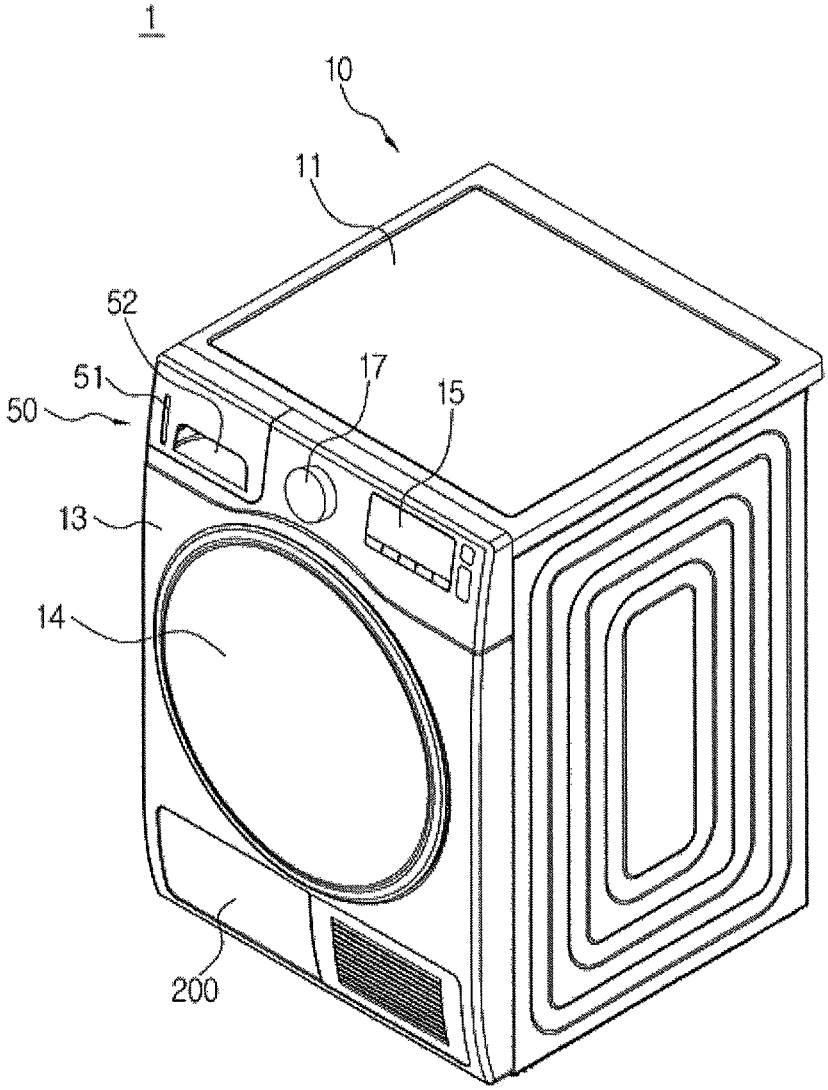
FIG. 2 is a view illustrating a clothes dryer in accordance with one embodiment of the present disclosure.
Figure 3:
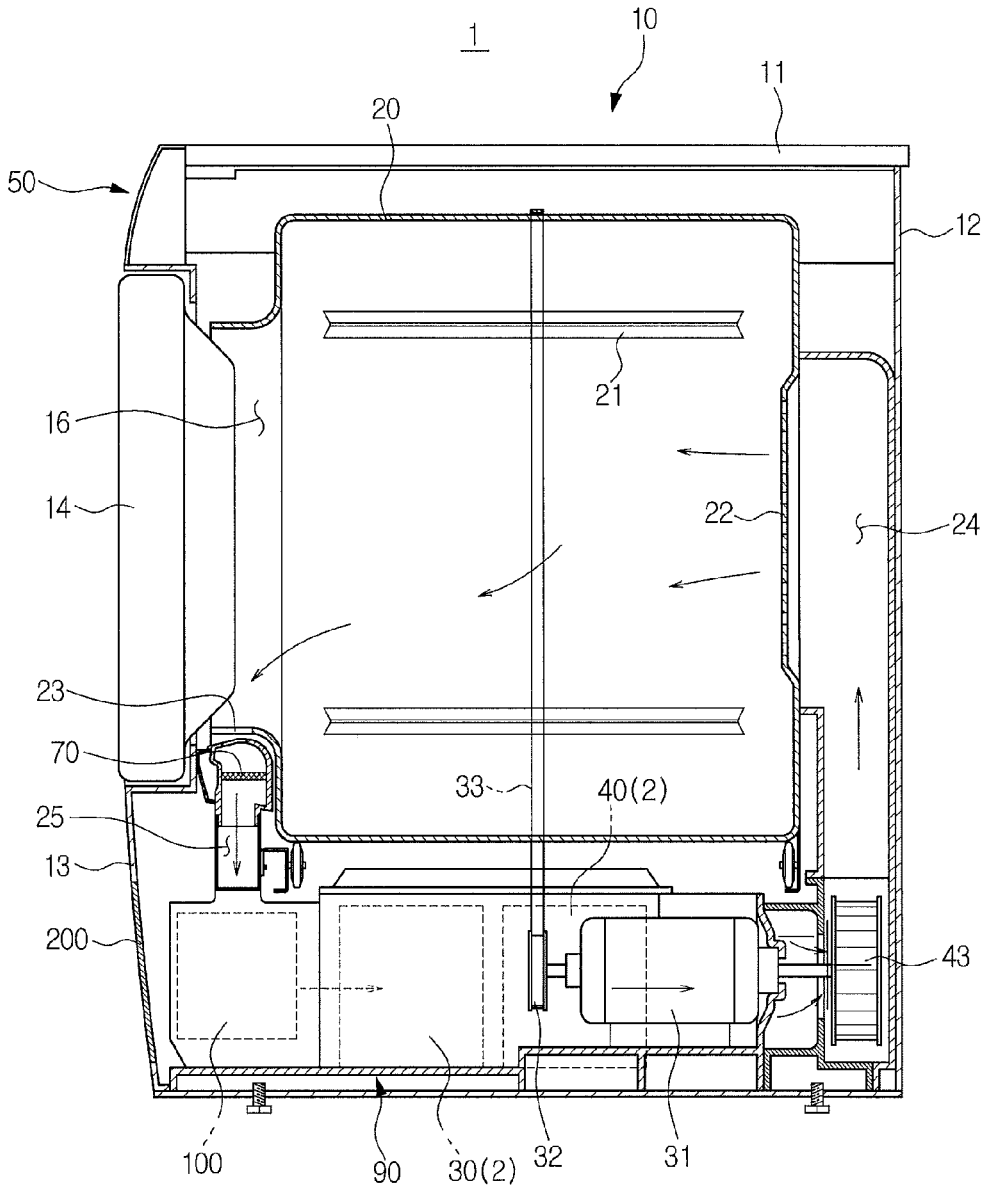
FIG. 3 is a cross-sectional view illustrating a clothes dryer in accordance with one embodiment of the present disclosure.

FIG. 2 is a view illustrating a clothes dryer 1 in accordance with one embodiment of the present disclosure, FIG. 3 is a cross-sectional view illustrating a clothes dryer 1 in accordance with one embodiment of the present disclosure, and schematically illustrates a lower structure of the clothes dryer 1, including a filter unit 100, to indicate the flow of air. FIG. 4 is a view illustrating a base of the clothes dryer in accordance with one embodiment of the present disclosure.

As illustrated in FIGS. 2 and 3, a clothes dryer 1 may include a body 10, a drum 20 installed inside the body 10. The body 10 may include a frame 12, a top cover 11 covering an upper portion of the frame 12, and a front panel 13 disposed on a front surface of the frame 12.

As illustrated in FIGS. 3 and 4, a base 90 may be mounted to the lower portion of the body 10. At the base 90, a compressor 3, a condenser 40, an evaporator 30, and the like, all of which are needed for the refrigerant cycle, may be placed and additionally a circulation fan 43 and a driving motor 31 may be provided. A base cover (not shown) may be coupled to an upper portion of the base 90 to cover the evaporator 30 and the condenser 40.

At the front of the body 10, a door 14 configured to open/close the drum 20 may be provided. At the front panel 13, an inlet 16 may be formed to insert laundry into the drum 20. The door 14 may be installed at the front of the inlet 16, and may be rotatably hinge-coupled to one side of the inlet 16.

At an upper portion of the front panel 13, the water collection tank 50 may be provided. As mentioned above, the water collection tank 50 may store condensed water discharged from the condensed water collector 60. The condensed water collector 60 may include a drain hole 62 and 64 connected to a drain pipe (not shown). By a drain pump 65, condensed water in the condensed water collector 60 may be discharged to the drain hole 62 and 64 and to be moved to the water collection tank 50. The condensed water collector 60 may include a water level detecting sensor 66 to detect a water level of condensed water.

At a front surface of the water collection tank 50, a handle unit 52 may be disposed for users to grip. In addition, at the front surface of the water collection tank 50, a display window 51 may be disposed. The display window 51 may be formed to be transparency so that users may detect the amount of condensed water stored inside the water collection tank 50. Users may confirm the display window 51 and pull the water collection tank 50 to discharge condensed water stored in the water collection tank 50.

At the front panel 13, a rotary switch 17 and a display unit 15 may be disposed to control the clothes dryer 1. Users may grip and rotate the rotary switch 17 to select a mode of the clothes dryer 1. The display unit 15 may display an operation status of the clothes dryer 1, and a manipulation status of users.

The drum 20 may be rotatably installed inside the body 10 to accommodate laundry. At the inside of the drum 20, a plurality of lifters 21 may be disposed in a circumferential direction of the drum 20. The lifter 21 may be disposed to effectively dry laundry by ascending and descending laundry.

The drum 20 may be rotated by a belt 33 coupled to the outside of the drum 20. The driving motor 31 may be disposed on one side of the drum 20, and may include a pulley 32 configured to rotate by receiving a torque from the driving motor 31. The belt 33 may connect the pulley 32 to the drum 20 to transmit a power of the driving motor to the drum 20.

The drum 20 may include an inlet 22 and an outlet 23 so that air is circulated. The inlet 22 may be disposed on a rear portion of the drum 20 and the out let 23 may be disposed on a front portion of the drum 20. Air introduced from the rear side through the inlet 22 may be discharged toward the front side through the outlet 23 after drying laundry.

The clothes dryer 1 may include a drying unit 2 configured to dry air passed through the drum 20. The drying unit 2 may be disposed inside the body 10, and may be illustrated to be installed on lower portion of the drum 20 in FIG. 3. As mentioned above, the drying unit 2 may include a heat exchanger, such as the evaporator 30 and the condenser 40, and alternatively, may be provide in various shapes.

The clothes dryer 1 may include a circulation fan 43 installed on a moving path of air to allow air to be circulated by connecting the drum 20 to the drying unit 2. The circulation fan 43 may be installed inside the body 10 and a lower portion of the rear surface of the drum 20. Air moved by the circulation fan 43 may be moved along a duct 24 and 25 as not to be discharged to the outside. The circulation fan 43 may be rotated by the driving motor (not shown) configured to drive the drum 20.

An intake duct 24 may be provided in a path in which air introduced to the drum 20 is passed through and a discharge duct 25 may be provided in a path in which air discharged from the drum 20 is passed through. The intake duct 24 may be disposed on the rear of the drum 20 and may be in communication with the inside of the drum 20 through the inlet 22 formed on the drum 20. The discharge duct 25 may be disposed on the front of the drum 20, and may guide the discharge of high temperature and high humid air that is passed through the inside of the drum 20.

As for the flow of air circulating inside the clothes dryer 1, air is discharged from the inside of the drum 20 through the outlet 23. The discharged air is introduced to the drying unit 2 along the discharge duct 25. Air changed into dried air after having passed through the drying unit 2 may be guided to the intake duct 24 along a guide duct 45. Therefore, air may be introduced to the inside of the drum 20 through the inlet 22 by moving along the intake duct 24. Air may dry laundry by circulating in a series of processes.

Foreign substance, such as lint, may be contained in air while air passes through laundry. Since air is not discharged and circulated inside the clothes dryer 1, the removal of the foreign substance may be needed. Therefore, the clothes dryer 1 may include filters 70 and 100 for filtering air.

The filters 70 and 100 may include a first filter 70 filtering air passed through the drum 20, and a second filter 100 filtering air passed through the first filter 70. The first filter 70 may be disposed on one side portion of the drum 20, and the second filter 100 may be disposed between the drying unit 2, and the first filter 70. That is, air may be circulated in a way that air is discharged from the drum 20 and passed through the first filter 70, the second filter 100, and the drying unit 2 in order.

Figure 5:
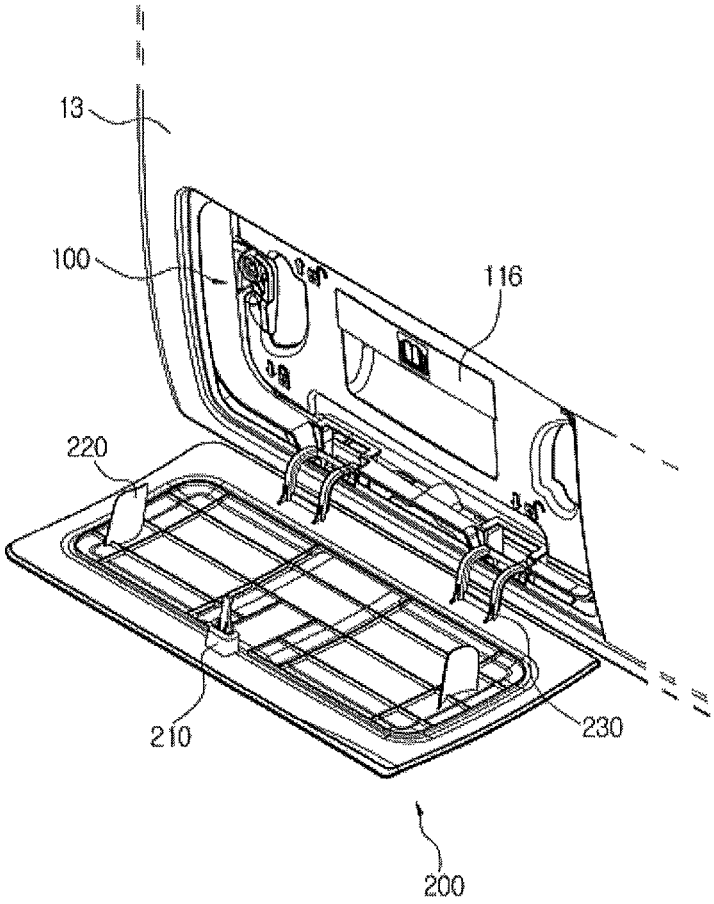
FIG. 5 is a view illustrating a status of a filter unit mounted to the clothes dryer in accordance with one embodiment of the present disclosure.
Figure 6:
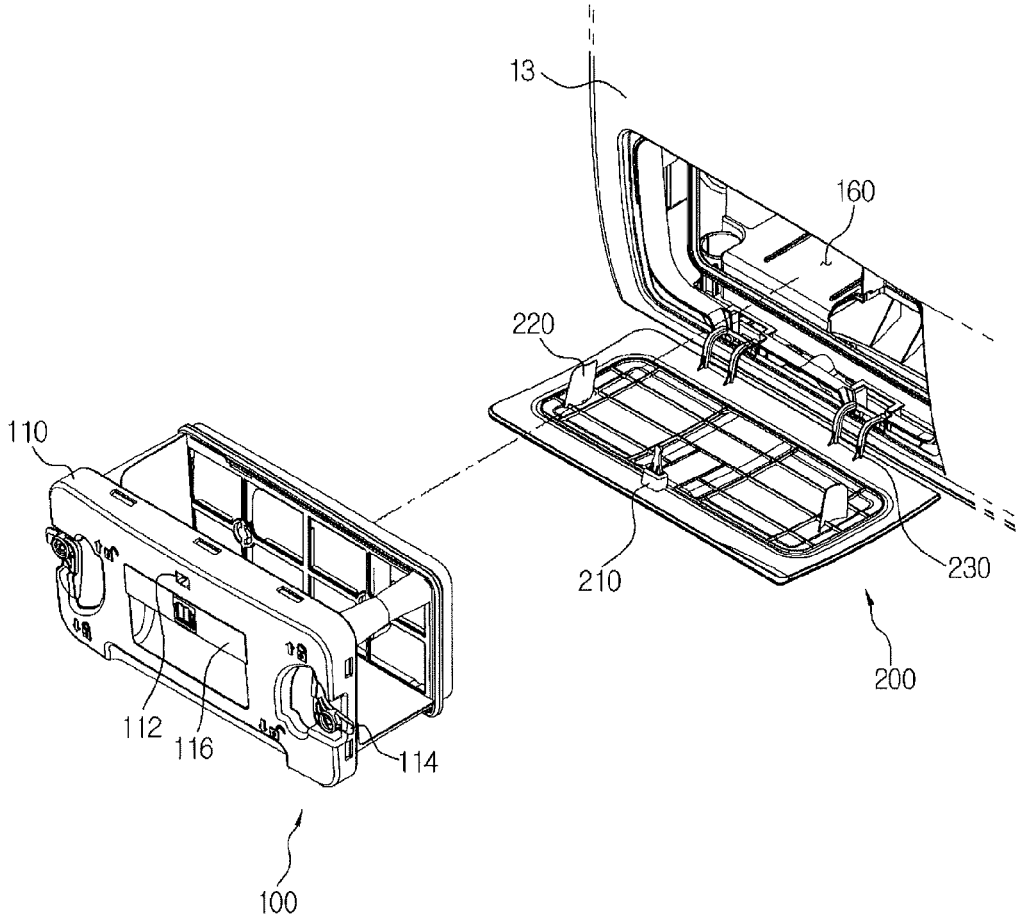
FIG. 6 is a view illustrating a status of a filter unit separated from the clothes dryer in accordance with one embodiment of the present disclosure.

Hereinafter, the second filter 100 is referred to as a filter unit, and will be described in detail. The first filter 70 may be disposed in the front of the filter unit 100, and may be a primary filter unit FIG. 5 is a view illustrating a status of a filter unit 100 mounted to the clothes dryer in accordance with one embodiment of the present disclosure, and FIG. 6 is a view illustrating a status of a filter unit 100 separated from the clothes dryer in accordance with one embodiment of the present disclosure. FIGS. 5 and 6 illustrates enlarging one side of the front surface of the clothes dryer 1 to describe a filter unit 100 and a filter cover 200.

As illustrated in FIG. 2, the filter cover 200 may form an external appearance of a front surface of the body 10 together with the front panel 13. The body 10 may include a filter opening 160 to allow the filter unit 100 to be installed inside the body 10, and the filter cover 200 may be installed to open/close the filter opening 160. The filter cover 200 may be a lower portion of the front panel 13, and the filter cover 200 and the filter unit 100 may be disposed on one side of a lower portion of the door 14.

The filter unit 100 may be disposed between the drum 20 and the drying unit 2 to filter air, and may be detachable from the body 10 to remove foreign substance filtered. Therefore, the filter unit 100 may be installed on or separated from the body 10 through the filter opening 160. At a front surface of the filter opening 160, the filter cover 200 may be disposed, and at a rear portion of the filter opening 160, the drying unit 2 may be disposed. That is, the filter cover 200 is disposed on the front surface of the filter unit 100, and the drying unit 2 may be disposed on the rear surface of the filter unit 100.

The filter cover 200 may be rotatably coupled to the body 10 to open the filter opening 160. The filter cover 200 may include a rotation member 230 rotatably coupled to one side of the filter opening 160. In FIG. 2, the filter cover 200 closes the filter opening 160 by forming an external appearance with the body 10. In FIGS. 5 and 6, the filter cover 200 opens the filter opening 160 by being rotated with respect to the body 10.

As illustrated in FIG. 5, when the filter cover 200 is rotated with respect to the body 10, the filter unit 100 is exposed to the outside. As illustrated in FIG. 6, users may separate the filter unit 100 from the body 10 by gripping the handle 116 on the front surface of the filter unit 100. After cleaning the filter unit 100, users may mount the filter unit 100 to the body 10 and rotate the filter cover 200 to close the filter opening 160. Therefore, users may operate the clothes dryer 1.

However, users may operate the clothes dryer 1 without coupling the filter unit 100 to the body 10. Therefore, foreign substance in the air may be not filtered well, and the drying unit 2 disposed on the rear portion of the filter opening 160 is exposed and thereby the heat loss and the leakage of condensed water may occur. In addition, humid air flowed out from the drum 20 may be discharged to the outside, thereby affecting products in the surroundings.

In order to prevent this, the filter unit 100 and the filter cover 200 may include a coupling structure to correspond to each other. When the filter unit 100 is not mounted to the body 10, the filter cover 200 is not fixed to the body 10 also, and thus users may notice that the filter unit 100 is not mounted to the body 10. That is, the filter cover 200 may be provided with one side thereof being installed on the body 10 and the other side thereof being coupled to the filter unit 100.

Figure 7:
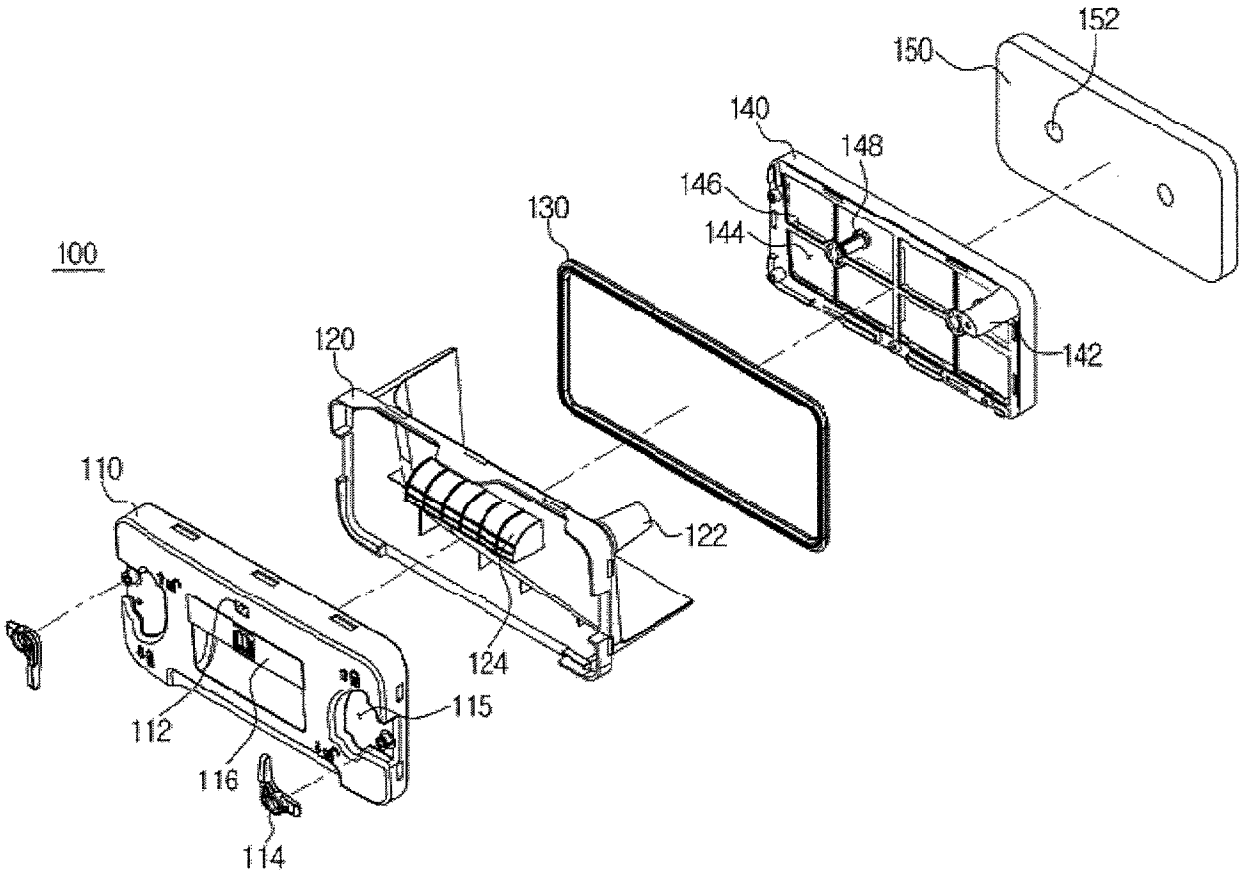
FIG. 7 is an exploded view illustrating a filter unit of the clothes dryer in accordance with one embodiment of the present disclosure
Figure 8:
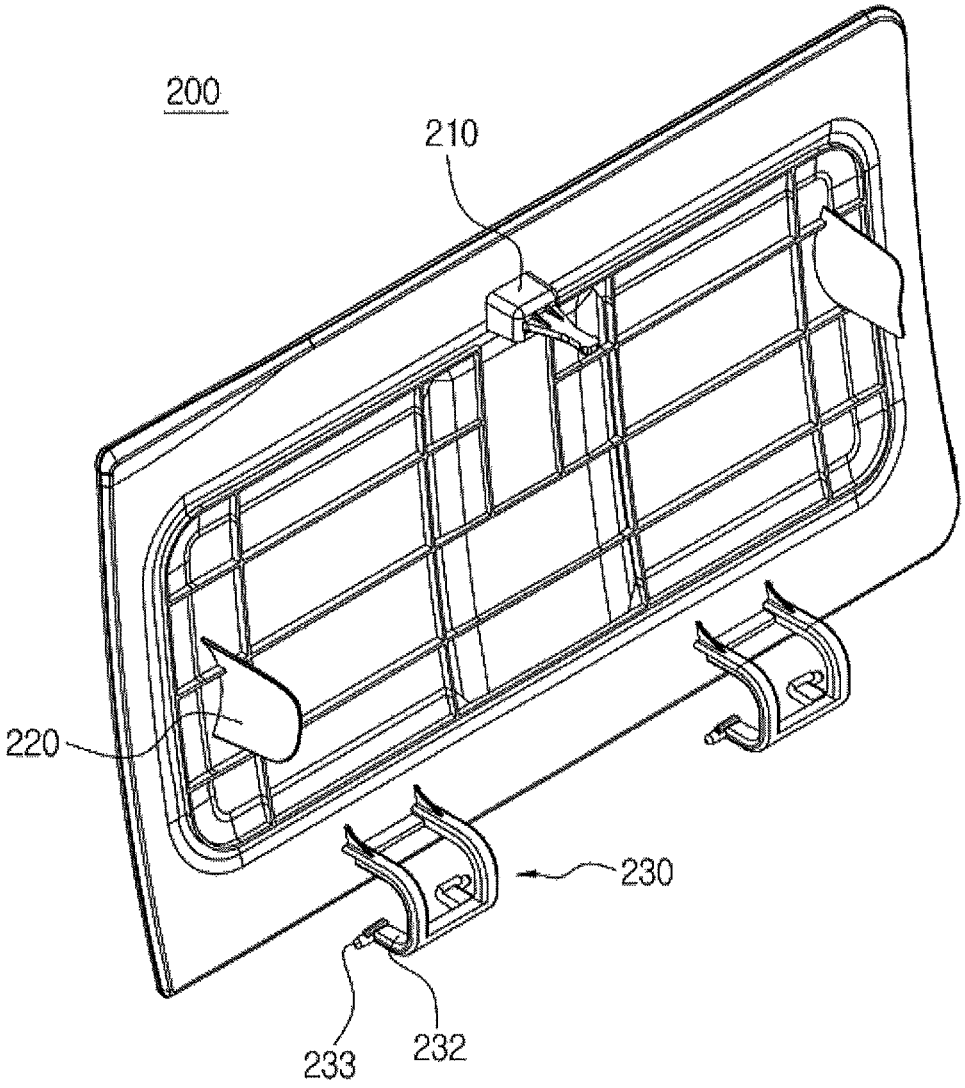
FIG. 8 is a view illustrating a filter cover of the clothes dryer in accordance with one embodiment of the present disclosure.

FIG. 7 is an exploded view illustrating a filter unit 100 of the clothes dryer 1 in accordance with one embodiment of the present disclosure, and FIG. 8 is a view illustrating a filter cover 200 of the clothes dryer 1 in accordance with one embodiment of the present disclosure.

The filter cover 200 may include a first coupling member 210, and the filter unit 100 may include a second coupling member 112 corresponding to the first coupling member 210. The first coupling member 210 may be disposed on a rear surface of the filter cover 200, and the second coupling member 112 may be disposed on a front surface of the filter unit 100. The first coupling member 210 and the second coupling member 112 may be connected, and the filter cover 200 may be fixed to the filter unit 100. The first coupling member 210 and the second coupling member 112 may be provided in various shapes to be pair to be fixed to each other.

As mentioned above, the filter cover 200 may include a rotation member 230 coupled to the body 10. The rotation member 230 may be disposed on a lower portion of the filter cover 20 and may be externally provided on a rear surface of the filter cover 200.

The rotation member 230 may include a coupling unit 232 coupled to one side of the body 10. A coupling protrusion 233 may be provided on both sides of the coupling unit 232. The coupling protrusion 233 may protrude toward both sides of the coupling unit 232 so that the filter cover 200 may be fixed to the left and the right of the body 10. Therefore, the lower portion of the filter cover 200 may be rotatably fixed to the body 10 and the upper portion of the filter cover 200 may open/close the filter opening 160 by being rotated.

The first coupling member 210 and the rotation member 230 may be vertically spaced apart from each other. Therefore, when the filter unit 100 is separated from the body 10, the filter cover 200, which an upper portion thereof is not fixed, may be rotated with respect to the body 10. That is, according to whether the filter unit 100 is coupled to the body 100, the filter cover 200 may open/close the filter opening 160 by being rotated. Users may visually detect that the filter opening 160 is exposed since the filter cover 200 is rotated and may notice that the filter unit 100 is not mounted.

In another words, when the filter unit 100 is mounted, the lower portion of the filter cover 200 is rotatably fixed to the body 10 and the first coupling member 210 disposed on the upper portion of the filter cover 200 is connected to the second coupling member 112. Therefore, the filter cover 200 may form an external appearance of the body 10 to be fixed while closing the filter opening 160. When the filter unit 100 is separated from the body 10, the upper portion of the filter cover 200 may not fixed, and the filter cover 200 may open the filter opening 160 by the rotation of the rotation member 230 disposed on the lower portion of the filter cover 200.

In addition, in order to prevent users from accidentally removing the filter unit 100, the filter unit 100 may be installed to be fixed to the body 10. The filter unit 100 may include a fixation member 114 disposed on the front surface thereof to help users to manipulate. Users may fix the filter unit 100 to the body by gripping and rotating the fixation member 114.

The filter cover 200 may include a check member 220 corresponding to the fixation member 114 to detect whether the filter unit 100 is fixed. The fixation member 114 of FIG. 6 illustrates the filter unit 100 in a locked state. The filter unit 100 may include an installation unit 115 formed in a concave manner so that the fixation unit 114 may be rotated. When the fixation member 114 is the locked state, the check member 220 protrudes in a certain shape to correspond to the installation unit 115 which is hollow.

Furthermore, the filter unit 100 may include a plurality of fixation members and the filter cover 200 may include a plurality of check members which correspond to the plurality of fixation members, as shown in FIGS. 6 and 7.

The fixation member 114 may be disposed the front surface of the filter unit 100, and the check member 220 may be disposed the rear surface of the filter cover 200. The installation unit 115, in which the fixation member 114 is installed, may be provided in a concave manner on the front surface of the filter unit 100. The check member 220 may protrude to be extended to the installation unit 115. Therefore, when the fixation member 114 is not in a locked state by being rotated, the check member 220 may interrupt the fixation member 114 so that the filter cover 200 may not fixed to the filter unit 100.

Hereinafter, components of a filter unit 100 of FIG. 7 may be briefly described.

The filter unit 100 may include the second coupling member 112, the fixation member 114, and the front cover 110 provided with the handle 116. A casing 120 and 140, in which air passes through, may be provided at the rear of the front cover 110. The casing 120 and 140 may include a first casing 120 provided on the front and a second casing 140 provided on the rear.

The first casing 120 may include a first connection unit 122 and the second casing 140 may include a second connection unit 142. Therefore, the first connection unit 122 may be connected to the second connection unit 142 to be coupled to each other. A handle 124 may be provided on the front surface of the first casing 120. The first casing 120 may be provided in a shape of a frame 146. An opening 144 disposed between the frames 146, mesh may be installed.

At the casing 120 and 140, a sealing member 130 may be provided to prevent the heat loss of the heat exchanger (evaporator 30 and condenser 40) and the leakage of condensed water. At the rear of the second casing 140, a rear filter 150 may be disposed. The first casing 120 may include a protrusion 148 protruding toward the rear filter 150 and the rear filter 150 may include a hole 152 corresponding to the protrusion 148 to be coupled to each other.

As is apparent from the above description, according to the proposed clothes dryer provided with a filter unit and a filter cover having a coupling structure corresponding to each other, users may notice that the filter unit is not assembled when the filter unit is not assembled. When the filter cover is not coupled to the filter unit, the filter cover may allow users to notice that the filter unit is not assembled by being rotated with respect to the body, since one side of the filter cover is rotatably coupled to the body, Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes dryer comprising:

a body having a filter opening at a front side thereof;

a drum installed inside the body;

a drying unit configured to condense air passed through the drum;

a filter unit detachably installed in the body, the filter unit having a filter for filtering air to be introduced to the drying unit; and a filter cover coupled to the body by a rotation member formed on a lower portion of the filter cover, the filter cover being configured to rotate between an open position where the filter unit is accessible through the filter opening and a closed position where the filter unit is covered by the filter cover, wherein the filter cover comprises a first coupling member formed on an upper portion of the filter cover, the filter unit comprises a second coupling member formed on an upper portion of the filter unit, the second coupling member corresponding to the first coupling member, and when the filter unit having the second coupling member is installed in the body, the filter cover can be maintained in the closed position by coupling the first and second coupling members.

2. The clothes dryer of claim 1, wherein:

the first coupling member protrudes from a rear side of the filter cover, and the second coupling member is recessed from a front surface of the filter unit.

3. The clothes dryer of claim 1, wherein:

the body comprises a front panel provided with the filter opening at a lower portion thereof, and the filter cover together with the front panel forms an external appearance of a front surface of the body.

4. The clothes dryer of claim 1, wherein:

the filter unit comprises an installation unit and a fixation member formed in the installation unit to fix the filter unit to the body, the fixation member being configured to move between a locked position where the filter unit is fixed to the body and the installation unit is open, and an unlocked position where the filter unit is not fixed to the body and the installation unit is closed, and the filter cover comprises a check member corresponding to the installation unit and the fixation member where the check member can only be inserted into the installation unit when the installation unit is open and the filter unit is fixed to the body.

5. The clothes dryer of claim 4, wherein:

the fixation member is disposed at a front side of the filter unit, and the check member is disposed at a rear side of the filter cover.

6. The clothes dryer of claim 1, wherein:

the drying unit comprises a heat exchanger to exchange heat with air circulated within the clothes dryer, and the filter unit is disposed on one side of the heat exchanger when the filter unit is installed in the body.

7. The clothes dryer of claim 1, further comprising:

a circulation fan disposed on a moving path of air to circulate air between the drum and the drying unit.

8. The clothes dryer of claim 7, further comprising:

a primary filter unit to filter air to be introduced to the filter unit.

9. A clothes dryer comprising:

a body;

a drum installed inside the body;

a drying unit configured to dry air passed through the drum;

a first filter unit disposed on one side of the drum to allow air passed through the drum to penetrate through the first filter unit;

a second filter unit disposed between the drying unit and the first filter unit to allow air passed through the first filter to penetrate through the second filter unit;

a filter opening formed in the body so that the second filter may be installed inside the body; and a filter cover configured to cover the filter opening, the filter cover being rotatably coupled to the body by a rotation member formed on a lower portion of the filter cover, the filter cover being configured to rotate between an open position where the second filter unit is accessible and a closed position where the second filter unit is covered by the filter unit, wherein the filter cover comprises a first coupling member formed on an upper portion of the filter cover, the second filter unit comprises a second coupling member formed on an upper portion of the filter unit, the second coupling member corresponding to the first coupling member, and when the second filter unit having the second coupling member is not installed inside the body, the filter cover cannot be placed in the closed position.

* * * * *